US008147792B2

(12) United States Patent
Al Nashef et al.

(10) Patent No.: US 8,147,792 B2
(45) **Date of Patent: *Apr. 3, 2012**

(54) METHOD FOR THE PREPARATION OF REACTIVE COMPOSITIONS CONTAINING SUPEROXIDE ION

(75) Inventors: Inas Muen Al Nashef, Riyadh (SA); Saeed M. Al Zahrani, Riyadh (SA)

(73) Assignee: King Saud University, Rigadh (SA)

( * ) Notice: Subject to any disclaimer, the term of this patent is extended or adjusted under 35 U.S.C. 154(b) by 825 days.

This patent is subject to a terminal disclaimer.

(21) Appl. No.: 12/078,011

(22) Filed: Mar. 26, 2008

(65) Prior Publication Data

US 2009/0008262 A1 Jan. 8, 2009

Related U.S. Application Data

(60) Provisional application No. 60/929,608, filed on Jul. 5, 2007.

(51) Int. Cl.

| | |
|---|---|
| ***C25B 1/00*** | (2006.01) |
| ***C01B 15/04*** | (2006.01) |
| *C25B 1/02* | (2006.01) |
| *C01B 15/00* | (2006.01) |

(52) U.S. Cl. ..... 423/581; 205/615; 205/633

(58) Field of Classification Search ..... 205/352, 205/362, 633; 423/581

See application file for complete search history.

(56) References Cited

U.S. PATENT DOCUMENTS 7,763,768 B2 * 7/2010 Al Nashef et al. ..... 588/316
7,812,211 B2 * 10/2010 Al Nashef et al. ..... 588/316

FOREIGN PATENT DOCUMENTS

WO WO 02/26701 A2 * 4/2002

OTHER PUBLICATIONS

I.M. Al Nashef, M.L. Leonard, M.C. Kittle, M.A. Matthews, J.W. Weidner. "Electrochemical Generatino of Superoxide in Room-Temperature Ionic Liquids." Electrochemical and SOlid-State Letters, vol. 4, Issue 11. pp. D16-D18. Sep. 2001.*

J.S. Valentine, A.B. Curtis. "A convenient Preparation of Solutions of Superoxide Anion and the Reaction of Superoxide Anion with a Copper(II) Complex." Journal of the American Chemical Society. vol. 97, Issue 1. Jan. 1975.*

City Collegiate. "Solubility". <http://www.citycollegiate.com/chapter3d.htm> Retrieved archived webpage from Feb. 24, 2002 via Wayback Machine <http://web.archive.org>.*

Abbott et al.; "Deep Eutectic Solvents Formed Choline Chloride and Carboxylic Acids: Versatile Alternatives to Ionic Liquids," J. Am. Chem. Soc., 2004; 126;9142-9147.

Alnashef et al.; "A novel method for the synthesis of 2-imidazolones," Tetrahedron Letters, 2010, 51:1976-1978.

Che et al.; "Water-Induced Disproportionation of Superoxide Ion in Aprotic Solvents," J. Phys. Chem., 1996; 100:20134-20137.

Dominguez De Maria et al.; "Ionic liquids in biotransformations; from proof-of-concept to emergeing deep-eutectic-solvents," Current Opinion in Chem. Bio., 2011; 15:220-225.

Evans et al.; "Electroreduction of Oxygen in a Series of Room Temperature Ionic Liquids Composed of Group 15-Centered Cations and Anions," J. Phys. Chem. 2004; 108:7878-7886.

Hayyan et al.; "Generation of Superoxide Ion in Trihexyl (Tetradecyl) Phosphonium bis (Trifluoromethylsulfonyl) imide Room Temp . . . ," J. App. Sci., 2010; 10(12):1176-1180.

Huang et al.; "The Reduction of Oxygen in Various Room Temperature Ionic Liquids in the Temperature Range 293-318 K: Exploring the . . . ," J. Phys. Chem., 2009: 113:8953-8959.

Islam et al.; "A catalytic activity of a mercury electrode towards dioxygen reduction in room-temperature ionic liquids," Electrochemistry Comm., 2005; 7:789-795.

Islam et al.; "Two-electron quasi-reversible reduction of dioxygen HMDE in ionic liquids: Observation of cathodic maximum . . . ," J. Electroanalytical Chem., 2008; 623:147-154.

Islam et al.; "Stability of Superoxide Ion in Imidazolium Cation-Based Room-Temperature Ionic Liquids," J. Phys. Chem, 2009; 113:912-916.

Katayama et al.; "Electrochemical Reduction of Oxygen in Some Hydrophobic Room-Temperature Molten Salt Systems," J. Electrochemical Soc., 2004; 151(1):A59-A63.

Liu et al.; "Ionothermal synthesis of a three-dimensional zinc phosphate with DFT topology using unstable . . . ," Microporous and Mesoporous Materials; 2008; 115;624-628.

Nkuku et al.; Electrochemistry in Deep Eutectic Solvents, J. Phys. Chem., 2007; 111:13271-13277.

Rogers et al.; "Investigating the Mechanism and Electrode Kinetics of the Oxygen/Superoxide (O2/ . . . ," J. Phys. Chem., 2009; 113:17811-17823.

Sawyer, Donald T.; "Oxygen Chemistry," International Series of Monographs on Chemistry 26, 1991; Oxford University Press, New York / Oxford.

Sawyer et al.; "The Chemistry of Superoxide Ion," Tetrahedron Report No. 65, 1979; 35:1471-1481.

Shahbaz et al.; "Prediction of deep eutectic solvents densities at different temperatures," Thermochimica Acta, 2011; 515:67-72.

Smith et al.; "Properties and phase equilibria of fluid mixtures as the basis for developing green chemical processes," Fluid Phase Equilibria, 2011; 302:65-73.

* cited by examiner

*Primary Examiner* — Keith Hendricks
*Assistant Examiner* — Steven A. Friday
(74) *Attorney, Agent, or Firm* — Hart IP Law, LLC; Brian G. Hart

(57) ABSTRACT

The subject invention provides a potentially economically viable method for the preparation of reactive superoxide ion in deep eutectic solvents (DES). The superoxide ion can be used for many applications, e.g. the degradation of hazardous chemicals at ambient conditions or in the synthesis of some special chemicals, e.g. carboxylic acids, aldehydes, and ketones from the corresponding alcohols. The superoxide ion can be formed by either the electrochemical reduction of oxygen in DES or by dissolving Group 1 (alkali metals) or Group 2 (alkaline earth metals) superoxides, e.g. potassium superoxide, in DES, with/without chemicals used for the enhancement of the solubility of the metal superoxide in the DES, e.g. crown ethers.

9 Claims, No Drawings

METHOD FOR THE PREPARATION OF REACTIVE COMPOSITIONS CONTAINING SUPEROXIDE ION

This application claims priority from U.S. Provisional Application No. 60/929,608, filed 5 Jul. 2007, the entire contents of that application is hereby incorporated by reference.

BACKGROUND OF THE INVENTION

1. Field of the Invention

This invention relates to a process for a potentially economically viable method for the preparation of reactive superoxide ion in deep eutectic solvents.

2. Background of the Related Art

Superoxide ion is a reactive oxygen species formed by the one electron reduction of oxygen, has a longer lifetime than singlet oxygen and is capable of decolorizing (bleaching) stains and killing bacteria. Throughout this application, superoxide is represented as $O_2^{\bullet-}$ based on common literature practice.

Superoxide is very reactive in aqueous solutions and protic solvents. On the other hand, $O_2^{\bullet-}$ is quite stable in aprotic solvents. In general, $O_2^{\bullet-}$ behaves as an oxidant, and as a strong nucleophile, depending on the solvent, in particular on the pH or presence of an easily abstractable hydrogen atom. Superoxide also acts as a one-electron reductant of metal ions and complexes.

$O_2^{\bullet-}$ has been known by chemists as long as 1934 when Haber and Weiss (*J. Proc. R. Soc.,* 1934, A147, 332) have proposed that $O_2^{\bullet-}$ is formed in the decomposition of hydrogen peroxide and in the oxidation of ferrous ions by dioxygen in aqueous solutions. Sawyer and co-workers (Merritt, M. V. and Sawyer, D. T. *J. Org. Chem.* 1970, 35, 2157. Sugimoto, H.; Matsumoto, S.; and Sawyer, D. T. *Environ. Sci. Technol.,* 1988, 22, 1182) pioneered work on superoxide ion, particularly the direct electrochemical reduction of dissolved oxygen gas in aprotic solvents to form $O_2^{\bullet-}$ according to the following reaction $$O_2+e^-\rightarrow O_2^{\bullet-} \quad (1)$$

A comprehensive review of superoxide ion chemistry is given by Sawyer et al. (Sawyer, D. T., Sobkowiaand, A. k, and Roberts, J. L. *Electrochemistry for Chemists,* 2nd ed., chapter 9, Wiley Interscience New York, 1995). Superoxide ion can be formed directly from solvation of $KO_2$ in aprotic solvents, or electrochemically via direct cathodic reduction of dioxygen (typically E=−1.0V vs SCE). $O_2^{\bullet-}$ is a strong nucleophile and disproportionates in water to $O_2$ and hydroperoxide:

$$2O_2^{\bullet-}+H_2O\rightarrow O_2+HOO^-+HO^- \quad (2)$$

To avoid this reaction, generation and utilization of $O_2^{\bullet-}$ must be done in aprotic solvents. Acetonitrile (MeCN), dimethyl formamide (DMF) and dimethyl sulfoxide (DMSO) are commonly used.

Che et al. studied the water-induced disproportionation of the electrogenerated superoxide ion in MeCN, DMF, and DMSO media containing various concentrations of water using UV-vis spectroscopy (Che, Y.; Tsushima, M.; Matsumoto, F.; Okajima, T.; Tokuda, K.; and Ohsaka, T. *J. Phys. Chem.* 1996, 100, 20134).

In dipolar aprotic solvents superoxide ion is quite stable, because disproportionation to give the peroxide dianion ($O_2^{2-}$) is highly unfavorable (Sawyer, D. T. *Oxygen Chemistry*; Oxford University Press: New York, 1991. Afanas'ev, I. B. *Superoxide Ion. Chemistry and Biological Implications*; CRC Press: Boca Raton, Fla., 1989; Vol. 1). However, the addition of acidic substrates (HA), which act as a Brønsted acid, to stable solutions of $O_2^{\bullet-}$ in aprotic solvents accelerates the disproportionation, depending on the protic strength (acidity) of HA. Carter et al. (Carter, M. T., Hussey, C. L., Strubinger, S. K. D., and Osteryoung, R. A. *Inorg. Chem.* 1991, 30, 1149) showed that superoxide ion could be generated by the reduction of dioxygen in imidizalium chloride-aluminum chloride molten salt. However, the resulting superoxide ion was unstable and thus cannot be used as a reagent in subsequent reactions. Buzzeo et al. (Buzzeo, Marisa C.; Klymenko, Oleksiy V.; Wadhawan, Jay D.; Hardacre, Christopher; Seddon, Kenneth R.; Compton, Richard G. *J. Phys. Chem. A* 2003, 107, 8872) studied the electrochemical reduction of oxygen in two different room-temperature ionic liquids, 1-ethyl-3-methylimidazolium bis((trifluoromethyl)sulfonyl)imide and hexyltriethylammonium bis((trifluoromethyl)sulfonyl)imide. They used chronoamperometric measurements to determine the diffusion coefficient and concentration of the electroactive oxygen dissolved in the ionic liquid by fitting experimental transients to the Aoki model. They also determined the diffusion coefficient of the electrogenerated superoxide species. Zhang et al. (Zhang, D.; Okajima, T.; Matsumoto, F.; and Ohsaka T. J. Electrochem. Soc. 2004, 151, D31) analyzed the electrode reaction of the molecular $O_2/O_2^{\bullet-}$ couple at different electrodes in three 1-n-alkyl-3-methylimidazolium tetrafluoroborate ILs, 1-ethyl-3-methylimidazolium tetrafluoroborate, 1-n-propyl-3-methylimidazolium tetrafluoroborate, and 1-n-butyl-3-methylimidazolium tetrafluoroborate. The systems have been analyzed quantitatively using CV, normal pulse voltammetry, and hydrodynamic chronocoulometry. CV measurements showed that the redox reaction of the $O_2/O_2^{\bullet-}$ couple in these ILs is a quasi-reversible process and that the resulting $O_2^{\bullet-}$ is stable. They evaluated the relevant thermodynamic and kinetic parameters of the $O_2/O_2^{\bullet-}$ redox couple using cyclic and normal pulse voltammetry.

Shukla et al. (Shukla, A. K. and Singh, K. N. *Indian Journal of Chemical Technology* 2000, 7, 43) showed that $Et_4N^+$ $O_2^-$, generated in situ by the phase-transfer reaction of $KO_2$ with tetraethyl ammonium bromide readily oxidizes primary and secondary alcohols in dry DMF at room temp. As a result, primary alcohols are transformed into their corresponding acids, whereas secondary alcohols are converted to ketones in good yields. Kolarz et al. (Kolarz, B. N.; Rapak, A. *Makromolekulare Chemie* 1984, 185, 2511) studied the reaction of chloromethylated 1:99 divinylbenzene-styrene copolymer with $KO_2$ in the presence of phase-transfer catalysts. In DMS and in the presence of 18-crown-6, the hydroxymethylated polymer was the main product with a yield of 45%. In DMF the transformation of chloromethyl groups was highest, but only 60% of alcoholic groups were present in the product. In benzene, the transformation was only 25%. With tetrabutyl ammonium iodide as catalyst in a mixture of solvents, the transformation of chloromethyl groups proceeded with 85% yield and the product contained 80% hydroxyl groups. Rao and Perlin showed that the reaction between glucitol and $KO_2$ resulted in the loss of H-4 and the 5-mesyloxy (as well as 1-mesyl) substituent, and an almost quantitative conversion into enol ether. Tsuji and Takayanagi (Rao, V. S.; Perlin, A. S. *Canadian Journal of Chemistry,* 1981, 59, 333) showed that O—$(HO)_2C_6H_4$ underwent oxidative ring cleavage on treatment with CuCl in pyridine containing ROH(R=Me, Et, Pr, $Me_2CH$) to give 7-82% $RO_2CCH{:}CHCH{:}CHCO_2H$ (I). The same oxidation also occurred using $KO_2/CuCl_2$ and KOH/$CuCl_2$ in pyridine containing ROH in the absence of O. PhOH was also oxidized with the above systems to give I.

U.S. Pat. No. 6,225,273 disclosed photochemical superoxide generators useful as photobleaches for laundry detergent compositions and as photobleaches or photodisinfectants for use in hard surface cleaning compositions. The compounds described therein comprise an amino-containing electron transfer moiety bonded to the photosensitizing unit wherein the amino-containing moiety is capable of transferring an electron to the photochemically excited π electron cloud of the photosensitizer unit thereby enabling superoxide formation.

U.S. Pat. No. 5,358,657 disclosed reagent compositions suitable for use in degrading and detoxifying polyhalogenated organic compounds comprising an aprotic solvent having dissolved therein (a) an effective amount of hydrogen donor, (b) an effective amount of a compound which produces hydroxide ion or alkoxide ion, and (c) dioxygen. These reagent compositions may be used to produce superoxide ion in situ for use in a variety of industrial applications to degrade halogenated hydrocarbons, e.g., PCBs. The generation of superoxide ion may be catalyzed by the presence of anthraquinone and derivatives thereof. Reagent compositions containing (a) an effective amount of hydrogen donor, e.g., hydroxylamine, (b) an effective amount of a compound which produces hydroxide ion or alkoxide ion and (c) dioxygen are also shown. In preferred methods, the dioxygen is bubbled through the solutions to continuously form superoxide ion.

U.S. Pat. No. 5,143,710 provided methods for generating superoxide ions in an aprotic solvent. In each method a compound that is dependent on the particular reaction mechanism of the method reacts with dioxygen dissolved in the aprotic solvent and hydroxide ions or alkoxide ions in solution in the aprotic solvent to generate the superoxide ions. In the first method, hydrogen donor compounds such as aniline and N-substituted anilines, or phenylhydrazine and phenylhydrazine derivatives, react with the dioxygen and hydroxide ions or alkoxide ions to generate concentrations of superoxide ions in the aprotic solvent. In the second method, proton donor compounds such as hydroxylamine and N-substituted hydroxylamines react with the dioxygen and hydroxide ions or alkoxide ions to generate concentrations of superoxide ions in the aprotic solvent. In the third method, hydrazine reacts with the dioxygen and hydroxide ions or alkoxide ions to generate superoxide ions in the aprotic solvent when catalyzed by anthraquinone and anthraquinone derivatives. The solution of superoxide ions in an aprotic solvent may then be used to degrade halogenated hydrocarbons. In addition, several other methods have been developed to generate superoxide ions. For example, pulse radiolysis of dioxygen has been used to generate superoxide ions (Gebicki et al. J. Am. Chem. Soc. 1982, 104, 796). Further, photolysis of hydrogen peroxide in aqueous media, and base-induced decomposition of hydrogen peroxide have also been used to generate superoxide ions (McDowell et al. Inorg. Chem. 1983, 22, 847; and Morrison et al. Inorg. Chem. 1979, 18, 1971).

U.S. Pat. No. 4,199,419 disclosed a photochemical method and apparatus for generating superoxide radicals in an aqueous solution by means of a vacuum-ultraviolet lamp of simple design. The lamp is a microwave powered rare gas device that emits far ultraviolet-light. The lamp includes an inner loop of high purity quartz tubing through which flows an oxygen-saturated sodium formate solution. The inner loop is designed so that the solution is subjected to an intense flux of far-ultraviolet light. This causes the solution to photodecompose and form the product radical.

U.S. patent application No. 20060011465 disclosed a plasma driven, N-Type semiconductor, thermoelectric-power superoxide ion generator with critical bias conditions.

Solutions of superoxide ion in aprotic solvents have also been prepared using electrochemical means (Sawyer et al. Anal. Chem. 1982, 54, 1720). For example, the superoxide ions used for degrading halogenated hydrocarbons in U.S. Pat. Nos. 4,468,297 and 4,410,402, are generated in a controlled potential electrolysis cell which uses aprotic solvent for the electrolyte.

Potassium superoxide is a product particularly well suited for the regeneration of a breathable atmosphere because it has the characteristic of fixing carbon dioxide gas and water vapor and releasing oxygen according to the reactions:

$$2KO_2 + CO_2 \rightarrow K_2CO_3 + \frac{3}{2}O_2 \tag{3}$$

$$2KO_2 + H_2O \rightarrow 2KOH + \frac{3}{2}O_2 \tag{4}$$

This characteristic is used to make atmosphere regenerators having closed chambers and respiratory apparatus that operate in a closed circuit.

U.S. Pat. No. 4,101,644 disclosed a method for the preparation of calcium superoxide in high yields from calcium peroxide diperoxyhydrate.

U.S. Pat. No. 4,088,595 disclosed an invention relates to an improved detergent composition that produces superoxide ion. This composition comprises at least one hydrosoluble salt of a metal selected from the group consisting of divalent iron, divalent cobalt and divalent nickel, associated with at least one hydrosoluble ligand which is a hydrogen donor and has at least two sites available for fixing to the said metal.

The methods described above for generating superoxide ions suffer from several disadvantages and are not appropriate for all applications. For example, methods for generating superoxide ions based on pulse radiolysis, photolysis, or electrolysis, all require radiation or electrical energy sources. Typically, the energy costs for these methods are prohibitively expensive, especially for applications such as degrading halogenated hydrocarbons on an industrial scale. Likewise, methods for generating superoxide ions based on decomposing hydrogen peroxide may be prohibitively expensive for particular applications due to the cost of hydrogen peroxide. Consequently, other methods for generating superoxide ions are desired.

A deep eutectic solvent (DES) is a type of ionic solvent with special properties composed of a mixture which forms a eutectic with a melting point much lower than either of the individual components. The first generation eutectic solvents were based on mixtures of quaternary ammonium salts with hydrogen donors such as amines and carboxylic acids. The deep eutectic phenomenon was first described in 2003 for a 1 to 2 by mole mixture of choline chloride (2-hydroxyethyltrimethylammonium chloride) and urea. Choline chloride has a melting point of 302° C. and that of urea is 133° C. The eutectic mixture however melts as low as 12° C.

This DES is able to dissolve many metal salts like lithium chloride (solubility 2.5 mol/L) and copper(II) oxide (solubility 0.12 mol/L). In this capacity, these solvents could be applied in metal cleaning for electroplating. Because the solvent is conductive, it also has a potential application in electropolishing. Organic compounds such as benzoic acid (solubility 0.82 mol/L) also have great solubility and this even includes cellulose (filtration paper). Compared to ordinary solvents, eutectic solvents also have a very low VOC and are non-flammable. Other deep eutectic solvents of choline chloride are formed with malonic acid at 0° C., phenol at −40° C. and glycerol at −35° C.

Compared to ionic liquids that share many characteristics but are ionic compounds and not ionic mixtures, deep eutectic solvents are cheaper to make, much less toxic and sometimes biodegradable.

WO 2002 026381 disclosed an invention related to ionic compounds and methods for their preparation. In particular, the invention relates to ionic compounds comprising hydrated metal salts, which are liquid at low temperatures, generally below about 100° C.

WO 02/26701 A2 disclosed a method for the synthesis of DES compounds with a freezing point of up to 100° C. by the reaction of one amine salt (I), such as choline chloride with an organic compound (II) capable of forming a hydrogen bond with the anion of the amine salt, such as urea, wherein the molar ratio of I to II is from 1:1.5 to 1:2.5. The DES compounds are useful as solvents, and electrolytes for example in electroplating, electrowinning, electropolishing, and as catalysts.

WO 00/56700 disclosed a method for the synthesis of DES having a melting point of no more than 60° C., formed by the reaction of a quaternary ammonium compound or a mixture of two or more thereof; with a halide of zinc, tin or iron, or a mixture of two or more thereof.

We were the first to show that a stable superoxide ion can be generated in ILs [Al Nashef et al. Ph. D. Dissertation, 2004]. We also showed that hexachlorobenzene could be destroyed by the reaction of the superoxide ion generated in selected ionic liquids ("ILs"). However, the superoxide ion reacted with the cation of the IL wasting part of the solvent and producing undesired byproducts and hence, reducing the efficiency of the process.

From what was mentioned above it is clear that there is a need for a viable decontamination method that is inexpensive, occurs at ambient temperature, and most importantly, benign.

DETAILED DESCRIPTION OF THE INVENTION

The used DES were obtained from Scionix (UK) with a stated purity of 99%. The used halogenated compounds were obtained from different sources, e.g. Sigma-Aldrich, Acros. The stated purity of most of the used substrates was ≧99. All chemicals were used without further purification.

It was shown in the literature that a stable superoxide ion could be generated in different types of ILs by the electrochemical reduction of oxygen in ILs. [See for example AlNashef et al. Ph. D. dissertation, 2004]. It was also shown that the generated superoxide ion can degrade hexachlorobenzene in the IL 1-butyl-3-methylimidazolium hexafluorophosphate. ILs, however, are quite difficult to make, very expensive, and their toxicity has not yet been ascertained. Accordingly, none of these compounds has been registered and this currently limits their wide-scale use. In addition, only a small number of ILs is being produced in commercial quantities.

Compared to ionic liquids that share many characteristics but are ionic compounds and not ionic mixtures, deep eutectic solvents are cheaper to make, much less toxic and sometimes biodegradable.

We found that the superoxide ion can be generated by the reduction of molecular oxygen in DES without the use of a supporting electrolyte. The conductivity of DES is comparable to that of most ILs, e.g. the conductivity of Ethaline is 9 mS/cm. The electrochemically generated superoxide ion can be used to destroy small quantities of chlorinated hydrocarbons, their homologous/analogues, and similar chemicals at ambient conditions in DES. The aforesaid process is explained in the following paragraphs:

Electrochemistry was performed using an EG&G 263A potentiostat/galvanostat controlled by computer and data acquisition software. The electrode configuration was a glassy carbon working (BAS, 3 mm diameter) and a platinum mesh counter electrode (Aldrich) using Ag/AgCl as a reference electrode (Fisher Scientific).

Cyclic voltammetry (CV) tests were performed in DES, which were dried overnight in a vacuum oven at 50° C. The presence of a reduction peak at −1.1 V vs. Ag/AgCl reference electrode showed that the superoxide ion is produced. The presence of the reverse peak (oxidation of the superoxide ion) indicated that the superoxide ion is stable in the studied DES for the duration of the experiment.

For the bulk production of superoxide a membrane electrochemical reactor was used. The cathode and anode compartments were made of Plexiglas with appropriate openings to accommodate the electrodes and to load and unload solutions. A proton exchange membrane of different thickness was used as a separator between the cathode and anode compartments. Membranes were soaked in a boiling 5M NaOH solution for 2-3 h to get rid of $H^+$ and then in boiling distilled water for about 1 h. In some cases the membrane was soaked with DES for 24 h before being used. The anode and cathode compartments were made of Plexiglas. The outside frames of the reactor were made of either Plexiglas for clear visualization of the reactor contents or from metallic alloy with proper grooves to accommodate electrical heating elements. Silicon rubber gaskets were used for leak prevention. A reticulated vitreous carbon or Pt mesh was used as a working electrode. The cathode chamber containing DES (≈20 mL) was purged with argon for 20 min. The catholyte was first pre-electrolyzed until the background current fell to ≈1 mA. Then the potential was set to a value of −1.1 V vs. Ag/AgCl while bubbling oxygen into the DES. The solution was stirred with a magnet stirrer for several hours. A sample from the solution was then analyzed using UV-vis spectrophotometer. The presence of a peak at around 250 nm indicated the presence of the superoxide ion in the tested DES. Samples were taken at different times and the peak corresponding to the superoxide ion was seen to increase with time. After electrolysis, diethyl ether was used to extract the products and the remaining reactant from the DES. A sample of the extract was then analyzed with HPLC and GC/MS. The GC/MS analysis showed the absence of any degradation products. This means that the superoxide ion does not react with DES and that it can be used for selected applications.

A gas sampling bag had been used for the collection of evolved gaseous products from the reactor. The gaseous products and the sample drawn from the reaction mixture were analyzed for the identification of volatile and non-volatile products monitored by GC-MS. The gaseous contents in the sampling bags were analyzed as such by GC-MS using gas tight syringe, the analysis results showed that no degradation products were formed.

The electrochemical process was relatively slow; in addition, the power needed for this process is relatively high and with the increase of the cost of oil this may render the process uneconomical for destruction of large quantities of wastes or for the synthesis of large quantities of fine chemicals. Fortunately, we found that the superoxide ion can be generated by dissolving Group 1 (alkali metals) or Group 2 (alkaline earth metals) superoxides, e.g. potassium superoxide in DES without the need to use any additional chemicals which are usually used to enhance the solubility of these metal superoxides in aprotic solvents, e.g. crown ethers. In addition, increasing the temperature to about 50° C. increases the solubility of said superoxides drastically. The presence and stability of the superoxide ion in the tested DES were checked using UV-vis spectrophotometer. It is well known that the superoxide ion has a peak at around 250 nm. It is also known that the wavelength of this peak changes depending on the used solvent.

The generated superoxide ion was used for the destruction of chlorinated hydrocarbons as explained hereafter: A weighed amount of a chlorinated hydrocarbon was added to about 20 g of DES. The solution was mixed vigorously. After enough time, a sample from the solution was withdrawn and analyzed using HPLC and the resulting peak was compared to the peak of the corresponding chlorinated hydrocarbons in pure organic solvent, e.g. acetone. Then small weighed amounts of the metal superoxide, e.g. potassium superoxide, were added to the solution under vigorous mixing.

Samples were then taken and analyzed using HPLC until no peak for the chlorinated hydrocarbon compound is detected. The solution was then extracted using a proper solvent, e.g. diethyl ether, and the sample was analyzed using GC/MS. No peak was detected for chlorinated hydrocarbons or any known degradation products. Samples from the solution before extraction by ether were dissolved in water and analyzed using electro-spray ionization mass spectrometer. KCl salt was formed, as confirmed by electro-spray ionization mass spectrometry. Electro-spray ionization mass spectrometry confirmed also the presence of the bicarbonate anion in all cases. During the reaction, samples of the gases evolved from the reaction were collected using gas sampling bags. The samples were then analyzed using GC/MS. No gaseous products, other than water vapor, were detected.

We claim the following:

1. A method comprising:

generating a stable superoxide ion in a deep eutectic solvent (DES) or mixture of DESs, the generating comprising (a) electrochemically reducing oxygen in the DES(s), or (b) chemically dissolving Group 1 alkali metal superoxides or dissolving Group 2 alkaline earth metal superoxides in the DES(s); and wherein the DES or mixture of DESs has a freezing point of up to 100° C. and is a mixture of two or more compound formed by mixing of at least one amine salt of the formula $R^1 R^2 R^3 R^4 N^+ X^-$ (I) with at least one organic compound (II) which is capable of forming a hydrogen bond with $X^-$, wherein $R^1$, $R^2$, $R^3$ and $R^4$ are each independently:

H, optionally substituted $C_1$ to $C_5$ alkyl, optionally substituted $C_6$ to $C_{10}$ cycloalkyl, optionally substituted $C_6$ to $C_{12}$ aryl, optionally substituted $C_7$ to $C_{12}$ alkaryl, or wherein $R^1$ and $R^2$ taken together represent a $C_4$ to $C_{10}$ optionally substituted alkylene group, wherein the term "substituted" means that a group is substituted with at least one or more groups selected from OH, SH, $SR^5$, Cl, Br, F, I, $NH_2$, CN, $NO_2$, $COOR^5$, CHO, $COR^5$ or $OR^5$, wherein $R^5$ is a $C_1$ to $C_{10}$ alkyl or cycloalkyl group, and wherein the molar ratio of I to II is from 1:1.5 to 1:2.5.

2. The method of claim 1 wherein all of $R^1$, $R^2$, $R^3$, and $R^4$ are not identical.

3. A method as in claim 1 wherein compound II is urea, acetamide, thiourea, glyoxylic acid, malonic acid, oxalic acid dihydrate, trifluoroacetic acid, benzoic acid, benzyl alcohol, phenol p-methyl phenol, o-methyl phenol, m-methyl phenol, p-chloro phenol, D-fructose, or vanillin.

4. A method as in claim 1, wherein the molar ratio of I to II is about 1:2.

5. A method as in claim 1, wherein $R^4$ is a $C_1$ to $C_5$ alkyl or a $C_6$ to $C_{10}$ cycloalkyl group, substituted with at least one group selected from OH, Cl, Br, F, I, $NH_2$, CN, $NO_2$, $COOR^5$, $COR^5$, CHO or $OR^5$.

6. A method as in claim 1, wherein each of $R^1$, $R^2$, $R^3$, independently is a $C_1$ to $C_5$ alkyl or a $C_6$ to $C_{10}$ cycloalkyl group, and $R^4$ is a hydroxyalkyl.

7. A method as claimed in claim 1, wherein each of $R^1$, $R^2$, $R^3$, is methyl, and $R^4$ is hydroxyethyl.

8. A method as claimed in claim 1, wherein $X^-$ is chloride.

9. A method as claimed in claim 1, wherein $R^1$, $R^2$, $R^3$, and $R^4$ are as shown in the following table:

| $R^1$ | $R^2$ | $R^3$ | $R^4$ |
|---|---|---|---|
| Me | Me | Me | $C_2H_4OH$ |
| Me | Me | Benz | $C_2H_4OH$ |
| Me | Me | Et | $C_2H_4OH$ |
| Me | Me | Me | Benz |
| Me | Me | Me | $C_2H_4OCOMe$ |
| Me | Me | Me | $C_2H_4Cl$ |
| Me | Me | Me | $ClCH_2CHOHCH_2$ (R) |
| Me | Me | Me | $ClCH_2CHOHCH_2$ (S) |
| Me | H | H | H |
| Me | Me | H | H |
| Et | Et | Et | H |
| Et | Et | Et | Benz |
| Me | Benz | $C_2H_4OH$ | $C_2H_4OH$ |
| Me | H | H | $CH_2COOH$ |
| Me | Me | Me | Et |
| Me | Me | Me | $C_2H_4F$ |
| Me | Me | Me | $Me(CH_2)_{11}$ |
| Et | Et | Et | Me |
| Et | Et | Et | Benz |
| Me | Me | $C_2H_4OH$ | $C_2H_4OH$ |

wherein Me=methyl, Et=ethyl, and Benz=benzyl.

* * * * *